United States Patent [19]

Beckmann

[11] Patent Number: 4,681,018

[45] Date of Patent: Jul. 21, 1987

[54] CARTRIDGE FEED MECHANISM

[75] Inventor: Rudi Beckmann, Rötenberg, Fed. Rep. of Germany

[73] Assignee: Heckler & Koch GmbH, Fed. Rep. of Germany

[21] Appl. No.: 873,813

[22] Filed: Jun. 13, 1986

Related U.S. Application Data

[62] Division of Ser. No. 552,674, Nov. 17, 1983, abandoned.

[30] Foreign Application Priority Data

Nov. 26, 1982 [DE] Fed. Rep. of Germany ..... 3243746
Nov. 26, 1982 [DE] Fed. Rep. of Germany ..... 3243744
Nov. 26, 1982 [DE] Fed. Rep. of Germany ..... 3243745

[51] Int. Cl.[4] ..... F41D 10/04

[52] U.S. Cl. ..... 89/33.04; 89/33.17; 198/577; 198/608

[58] Field of Search ..... 89/33.01, 33.04, 33.14, 89/33.16, 33.17, 33.2, 33.25, 33.5; 198/366, 367, 371, 452, 577, 608

[56] References Cited

U.S. PATENT DOCUMENTS 4,434,701 3/1984 Voillot ..... 89/33.04

*Primary Examiner*—Stephen C. Bentley

[57] ABSTRACT

A cartridge feed mechanism for automatic firearms comprising an endless chain for feeding cartridges of different ammunition types which chain can be selectively driven in both directions is characterized in that a feeder device is provided which is or can be coupled with two magazine arrangements and which, due to its particular design, can alternatively feed cartridges from the one or the other magazine into the chain, depending on the direction of movement of the chain, and that the feeder device is so designed that every time the direction of movement of the chain is changed the cartridges already present in the chain are fed back while at the same time cartridges from the other magazine arrangement are fed into the chain.

6 Claims, 8 Drawing Figures

CARTRIDGE FEED MECHANISM

This is a divisional of co-pending application Ser. No. 552,674 filed on Nov. 17, 1983 now abandoned.

The present invention relates to a cartridge feed mechanism for automatic firearms comprising an endless chain for feeding cartridges of different ammunition types which chain can be selectively driven in both directions.

A mechanism of this type has been known from German Patent Specification (DE-C3) No. 28 39 839. The known mechanism has the overall design of a box-shaped magazine through which the chain passes along a meander-shaped path. The capacity of the known mechanism is limited to the holding capacity of the chain.

Now, it is the object of the present invention to give a mechanism of the type described above a design permitting the capacity, i.e. the number of cartridges that can be fed to the firearm, to be increased.

According to the invention, this object is achieved in that a feeder device is provided which is or can be coupled with two magazine arrangements and which, due to its particular design, can alternatively feed cartridges from the one or the other magazine into the chain, depending on the direction of movement of the chain, and that the feeder device is so designed that every time the direction of movement of the chain is changed the cartridges already present in the chain are fed back while at the same time cartridges from the other magazine arrangement are fed into the chain.

Preferably, the cartridges present in the chain when its direction of movement is changed are fed back into the magazine arrangement from which they had been originally fed into the chain. In certain individual cases it may, however, be convenient to provide a smaller separate magazine for the cartridges fed back from the chain, which separate magazine may also take the form of an endless chain. This is possible because the maximum number of cartridges that can be fed back when the ammunition type is changed will generally correspond to the capacity of half the chain. In any case, however, all cartridges fed back by the chain must be removed when changing the cartridge type and, thus, the direction of movement of the chain.

It results that in the arrangement of the invention the chain serves substantially as transport means for feeding cartridges from the feeder device to the weapon, rather than serving mainly as storage means. Accordingly, the holding capacity of the entire arrangement is determined by the capacity of the magazine arrangements. Due to the feeder arrangement, the moving chain can be constantly supplied with new cartridges from the one or the other magazine arrangement. The magazine arrangements can be arranged in an area where they do not obstruct the handling of the weapon. The arrangement of the invention is particularly suited for use in motor vehicles.

It is of course also possible to store the same ammunition type in both magazine arrangements. In this case, the direction of movement of the chain will generally be changed only when one magazine arrangement is completely empty.

The before-mentioned two magazine arrangements may be designed as independent magazines which can be detached individually as required. But the two magazine arrangements may also be designed as one structural unit.

In one embodiment of the invention, the design of the cartridge feed mechanism is such that the cartridges are fed into the chain through the same feeder element, in both directions of movement of the chain. This embodiment of the invention is particularly suited when the two magazine arrangements are united to one structural unit. In another embodiment of the invention, separate feeder devices are provided for each magazine arrangement. Considering that normally two different ammunition types are to be transported, this design provides a separate feeder device for each such ammunition type. If necessary, it is also possible to feed selectively more than two ammunition types by increasing the number of feeder devices and magazine arrangements.

The retaining means for the cartridges in the chain may conventionally consist of rods extending crosswise to the direction of movement of the chain at a distance corresponding to the diameter of one cartridge. But the retaining means may also conventionally consist of cups holding the cartridges. The cups may enclose the cartridges with a certain clamping effect (over more than half their circumference) or without any clamping effect (over less than half their circumference). The necessary deflection wheels for the chain may be either arranged in the area of the chain links and be designed in this case as thumb wheels, or else arranged in the area of the cartridges and in this case designed as star wheels provided along their periphery with cup-shaped recesses for receiving the cartridges or the cups of the chain. In the latter case, it is particularly easy to guide the cartridges in the deflection area of the chain safely and by simple means.

In one embodiment of the invention, at least one star wheel for guiding the chain is provided in an area facing away from the weapon, this star wheel being coupled to a part of the feeder device. By this arrangement a very compact design can be achieved, in particular when a single star wheel coacts with two (or more) magazine arrangements. Further, this arrangement makes it possible to feed a great number of different ammunition types, or else to feed the same type of ammunition from numerous different magazines. If, for instance, two star wheels are provided for guiding the chain, and if further each of the said star wheels is coupled to two magazine arrangements, ammunition can be fed from four magazine arrangements.

In one embodiment of the invention, at least two star wheels are provided each of which is coupled to one of the feeder devices. In this case, the distance between the ends of the feeder devices facing the chain may be greater than in an arrangement using a single star wheel, and this may be of advantage in certain cases.

In one embodiment of the invention the arrangement is such that the feeder device comprises a star wheel arranged adjacent the star wheel engaging the chain, that the two star wheels can be driven in opposite directions and that they are arranged and seated in a manner to ensure that their cup-shaped peripheral recesses are aligned in the area of the smallest radial distance between the star wheels. The two star wheels may together form common retaining means for a cartridge.

In one embodiment of the invention the cup-shaped peripheral recesses of the star wheel of the feeder device are shallower than would correspond to the radius of the cartridges. This embodiment is of advantage in connection with a construction that will be described further below.

In one embodiment of the invention the arrangement is such that the sector taken by one of the cup-shaped peripheral recesses of the star wheel of the feeder device is greater than that taken by one of the cup-shaped peripheral recesses of the star wheel engaging the chain, and that the two star wheels are driven at different circumferential speeds so that the peripheral recesses are always aligned with each other. This embodiment offers certain advantages in connection with an example that will be described further below, in which the cartridges are packed more closely in the magazine arrangement than in the chain.

In one embodiment of the invention the arrangement is such that the chain is substantially arranged within an ammunition channel and so that the two strands of the chain moving in opposite directions during motion of the chain are arranged directly adjacent each other, that the thickness of the ammunition channel corresponds at least to double the thickness of the chain when charged with cartridges, and that the feeder device is aarranged at the end of the ammunition channel facing away from the weapon. The advantage of this arrangement is to be seen in the fact that the magazine arrangements can be provided at a greater distance from the weapon and that the ammunition channel takes only little space. The thickness of the ammunition channel corresponds substantially to double the thickness of the chain when charged with cartridges, and thanks to this relatively small thickness of the ammunition channel, the chain will run without any trouble even if no special guide means are provided within the ammunition channel and even when the chain is not charged with cartridges.

The present invention further relates to a cartridge transport mechanism for transporting cartridges in a direction transverse to their longitudinal direction, comprising at least two neighboring star wheels that can be driven at equal circumferential speeds and in opposite directions and which are so seated and arranged that their cup-shaped peripheral recesses form common retaining means for a cartridge in the area of the smallest radial distance between the star wheels, with guides being provided to prevent the cartridges from sliding off the peripheral recesses.

A mechanism of this type has been known from German Disclosed Patent Application No. 28 22 168 (DE 28 22 168 A1).

In the known device which also uses a chain with a complex clamping mechanism, the cartridges pass through the device, in particular the star wheels, in one direction, and the direction of rotation of the star wheels is constant.

Now, it is the object of the present invention to give a mechanism of the before-mentioned type a design which is better suited for transporting different ammunition types to the weapon while ensuring at the same time that the change between different ammunition types, i.e. from one ammunition type to another, can be realized in a simple way.

According to the present invention, this object is achieved in that the design of the guides and their radial distance from the axes of the star wheels are suitably selected to permit the transportation of cartridges, for both directions of the movement of the star wheels, in the same direction of transportation, in that drive means coupled with the star wheels are provided for selectively driving the star wheels in alternative directions of movement, and that reversible guide elements for directing the cartridges into the peripheral recesses of the next following star wheels are provided on both sides of a plane extending through the axes of two neighboring star wheels, substantially in the area of a tangential plane applied to the two star wheels and extending perpendicularly to the said plane.

If in this arrangement several of the described pairs of star wheels are arranged in a line in the longitudinal direction of the transport mechanism, a cartridge being transported is over a certain portion of its path held between the peripheral recess and the guide, then—when it approaches the next star wheel—held between a pair of peripheral recesses in the two star wheels arranged directly behind each other in the longitudinal direction of the transport mechanism, and finally held between this next following star wheel and again the guide, but a different section of the latter. In the example described, the guides are formed by the walls of a housing. The advantage of this transport mechanism lies in the fact that the feeding direction of a cartridge being transported at any time can be easily reversed by reversing the directions of movement of all star wheels. When in the case of such reversal of the direction of movement the cartridges originally present in the transport mechanism have left the latter, moving away from the end of the trnasport mechanism facing the weapon, the reversible guide elements (which consist of guide cams in the example described) ensure that when the cartridges of preferably a second ammunition type are fed into the transport mechanism, without change of the direction of rotation of the star wheels, the cartridges are forcedly guided along the correct path and transferred from one star wheel to the next one.

Those cartridges which run through a specific path when passing the transport mechanism towards its end facing the weapon, will take the same path also in the opposite direction when the direction of rotation of the star wheels changes, while the position of the guide elements remains unchanged. The reversal of the guide elements is effected only when fresh cartridges, preferably of another ammunition type, are fed in, with the direction of rotation of the star wheels of the transport mechanism remaining unchanged, whereupon these cartridges take another path through the transport mechanism, corresponding to the sense of rotation of the individual cup wheels.

This arrangement is particularly suited for applications in which the transport mechanism is supplied with cartridges for instance by one chain and where different cartridge types are to be fed in response to the sense of rotation of the chain. It is in this case of particular advantage that when changing the ammunition during shooting—in which case the cartridges of the first type contained in the transport mechanism must be removed before the other cartridges are fed in—backfeeding of the cartridges to the chain is unambiguous so that there does not exist any risk of mixing up cartridges of the first and second types.

The transport mechanism can be realized in the simplest of all cases with rigid walls. Already a single star wheel coacting with another star wheel or cup wheel serving as deflection wheel for a chain may form a transport mechanism of the described type and, thus, be covered by the scope of the invention.

The guide elements may be controlled by a device determining, for instance by counting the number of revolutions of the star wheels, the moment when the mechanism has been emptied of all cartridges of a given type, after reversal of the sense of rotation of the star wheels. The guide elements could then be switched over at the moment thus determined to define the path to be taken by the other cartridge type to be subsequently fed. In one embodiment of the invention, however, this function is achieved by an arrangement in which at least one sensing element is provided which due to its particular arrangement responds to the passing of a cartridge in a pre-determined feeding direction, and in which the said sensing element is coupled with at least one guide element determining the further transport path of the said cartridge, for controlling the switching position of the said guide element. This embodiment can be realized in a particularly simple manner.

In one embodiment of the invention the sensing element is constituted by one of the reversible guide elements. The advantage of this arrangement is to be seen in the fact that in this case no separate sensing element must be provided in addition to the guide elements. The guide element serving as sensing element may be coupled, even by mechanical means, with all other reversible guide elements.

Another embodiment of the invention provides, however, that the guide elements arranged in the area of the tangential plane are so coupled with each other that they perform their reversing movements forcedly and simultaneously in pairs.

This means that here the guide elements are coupled with each other in pairs only. The advantage of this arrangement is to be seen in the fact that the first cartridge of another cartridge type entering the transport mechanism effects the reversal of the guide elements by pivoting in sequence the pairs of guide elements, one after the other, so that the force required for effecting such reversal is relatively small. This embodiment of the invention avoids safely any trouble in transport and eliminates the need for a separate driving mechanism for the guide cams.

Preferably, the design of the drive mechanism is such that the sense of rotation of the star wheels can be reversed while keeping the sense of rotation of the drive mechanism constant. This simplifies the mechanical structure still further and ensures trouble-free operation.

Depending on the distance to be overcome by the transport mechanism, two, three or more star wheels may be arranged in line. The axes of the star wheels may extend in one plane so that the main feeding direction extends along a straight line (leaving the wave-like movement about the star wheels out of regard). But the main feeding direction may also extend along a curved or kinked line. If several such star wheels are provided, the cartridges are normally not held simultaneously by a chain in the area of the said star wheels. The first and/or last star wheel of such a transport mechanism may conveniently also function as deflection wheel of a chain and, thus, be designed as a cup wheel.

The clear distance between two directly neighboring star wheels is suitably selected depending on the depth of the cup-shaped recesses between the teeth or thumbs of the star wheels. If the depth of the cup-shaped recesses corresponds substantially to half the thickness of the cartridges, the neighboring star wheels will have their outer faces arranged closely adjacent each other. If the cup-shaped recesses are shallower compared with the diameter of the cartridge, the clear distance will be greater. These dimensions are normally selected, but in no way binding as will appear for the example that will be described further below, in which the cup wheel whose cups enclose almost half the circumference of the cartridges exhibit a distinct distance to the outer face of the neighboring star wheel.

In the known mechanism mentioned at the outset, an ejector device acting in both directions of movement of the chain is provided near the weapon. In the known mechanism, this device is formed by a rotatably drivable cam. According to one embodiment of the invention there is provided a deflection wheel for the chain in the end portion of the chain facing the weapon, and further a cam seated for limited pivotal movement and having its end facing away from its pivot axis projecting into the path of the cartridges. The cam does not need any rotary drive. Rather, it is pivoted a little when the direction of movement of the chain is changed, either by a forced control or by the force exerted on the cam by the cartridges being transported by the chain. Being not rotatably driven, the cam requires relatively little space. The pivot angle of the cam may be relatively small. In one embodiment of the invention, the pivot path of the end of the cam projecting into the path of the cartridges is, for instance, smaller than would correspond to the diameter of a cartridge.

This cam is particulary advantageous when, as in the example described, the cartridges are not positively guided between the deflection wheel for the chain and the neighboring star wheel, and a clearance exists between the two mentioned wheels. In this case, the cam ejects from the chain any cartridge that hits against it and moves it into the peripheral recess of the neighboring star wheel. In the example described it seemed convenient to provide a clearance between the two mentioned wheels because there is subsequently a kink in the arrangement of the entire transport mechanism. Due to the clearance between the two mentioned star wheels, the cartridges cannot be safely removed from the chain and guided onto the neighboring star wheels by the guide elements alone, although these are also provided.

The loading opening of the weapon may in certain embodiments of the invention be arranged closely adjacent the pivoted cam. In the example described, however, a further transport mechanism is arranged between them.

Other features and advantages of the invention will be apparent from the claims and the following description of certain examples of the invention with reference to the drawings which show certain details essential to the invention. The individual features may be realized in any embodiment of the invention either individually or in any desired combination. In the drawings:

Figures 4, 4A, 5:
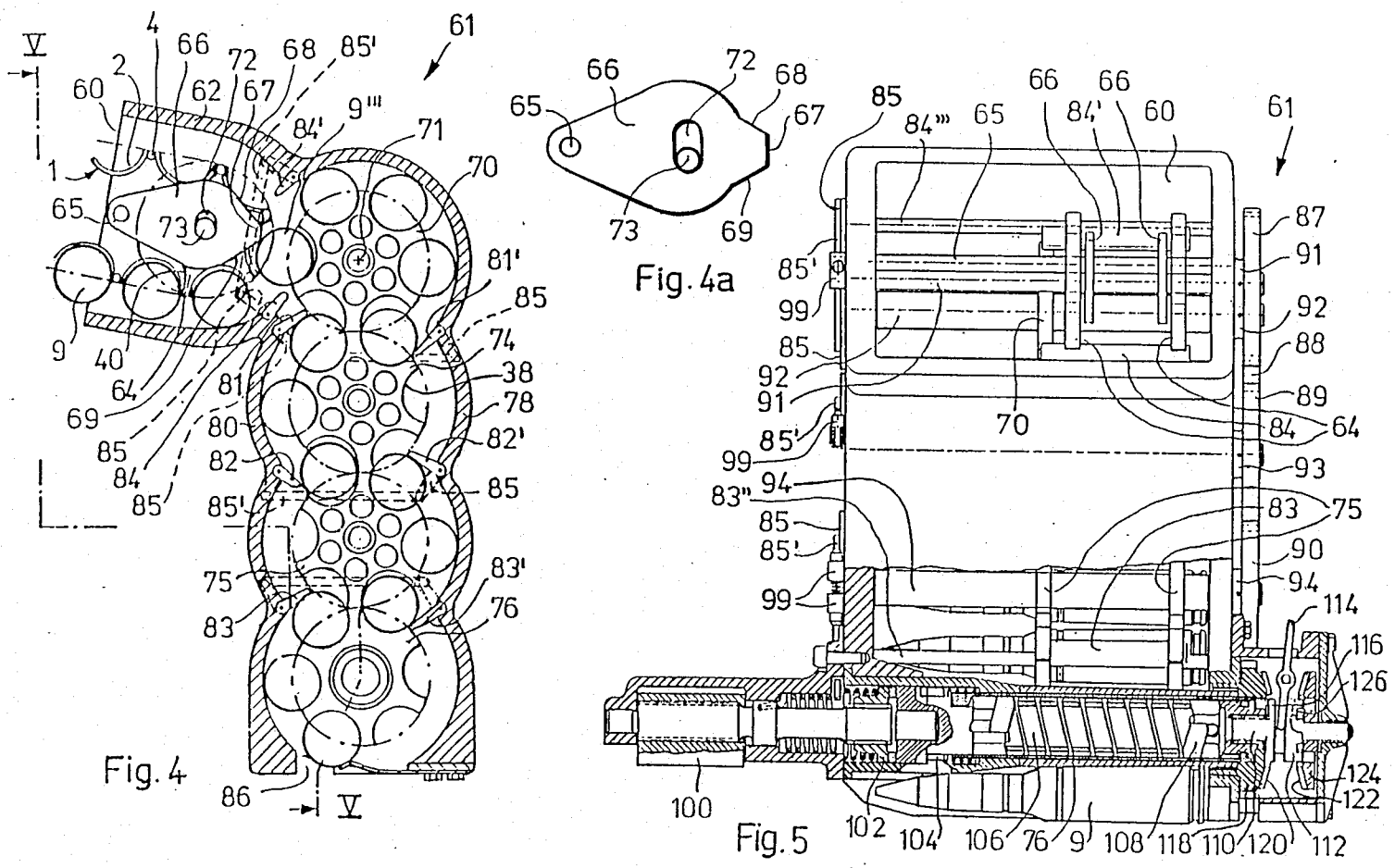
FIG. 4 shows a cross-section through a cartridge feed mechanism with a connecting piece containing an ejection cam, for connecting the mechanism to the proximate end of the flexible ammunition channel according to FIG. 3.
Figure 6:
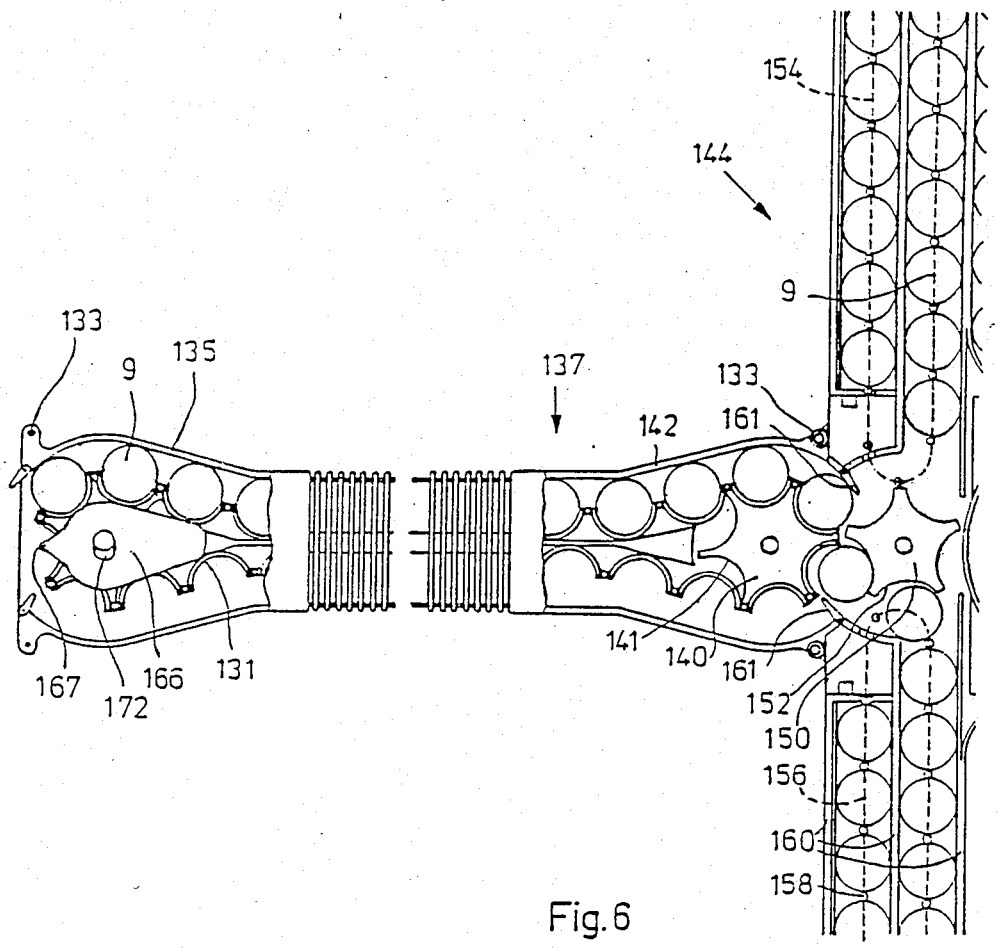
Figure 7:
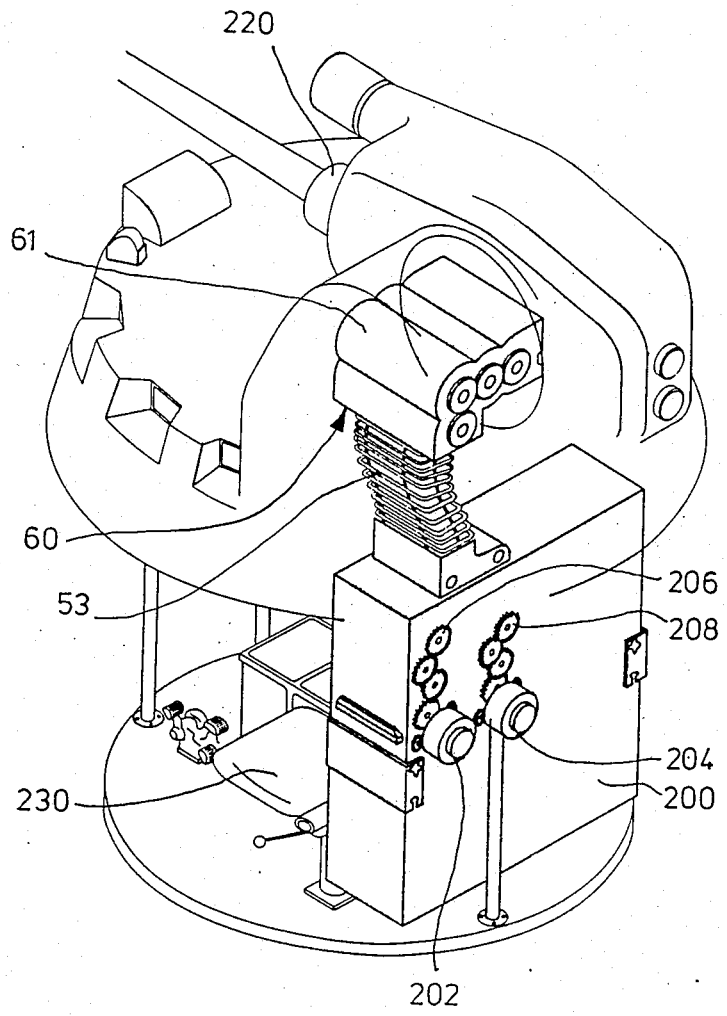

FIG. 4*a* shows the ejection cam in detail;

FIG. 5 is a lateral part-section along line V—V in FIG. 4;

FIG. 6 is a cross-section, partly broken away, through a feeder device coupled with the distant end of the flexible ammunition channel, for feeding two different cartridge types;

FIG. 7 is a perspective view of an overall arrangement comprising the parts shown in FIGS. 1, 3, 4 and 5 and a view of the magazine.

In the following description, the star-shaped wheels serving to guide and transport cartridges not guided in a chain will be described as star wheels, whereas those other star-shaped wheels which receive cups of the chain in their peripheral recesses will be normally described as cup wheels.

Figure 2:
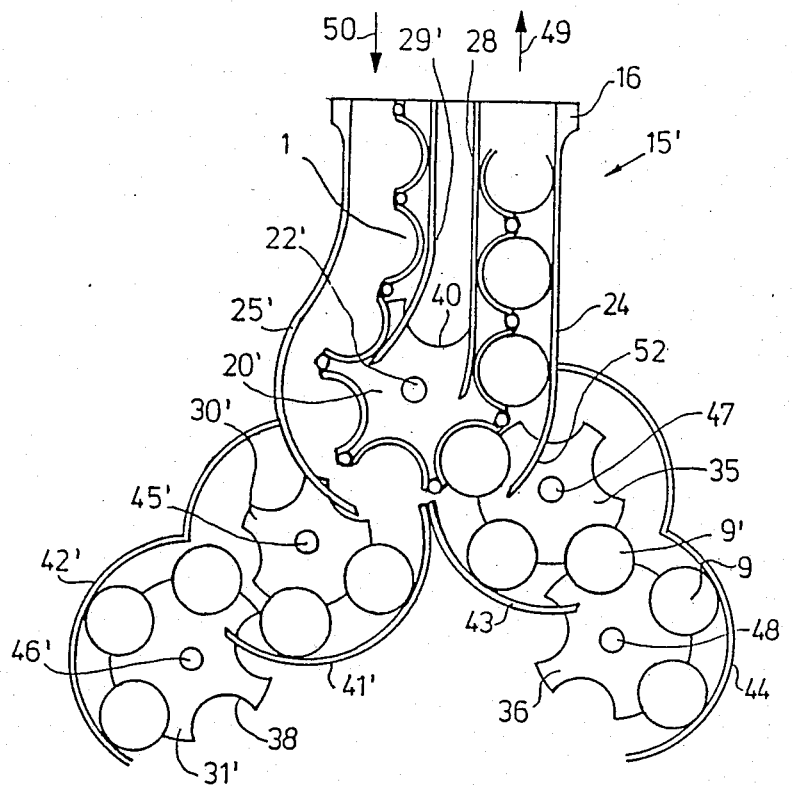
FIG. 2 shows a modified connecting piece in a representation similar to FIG. 1.
Figure 3:
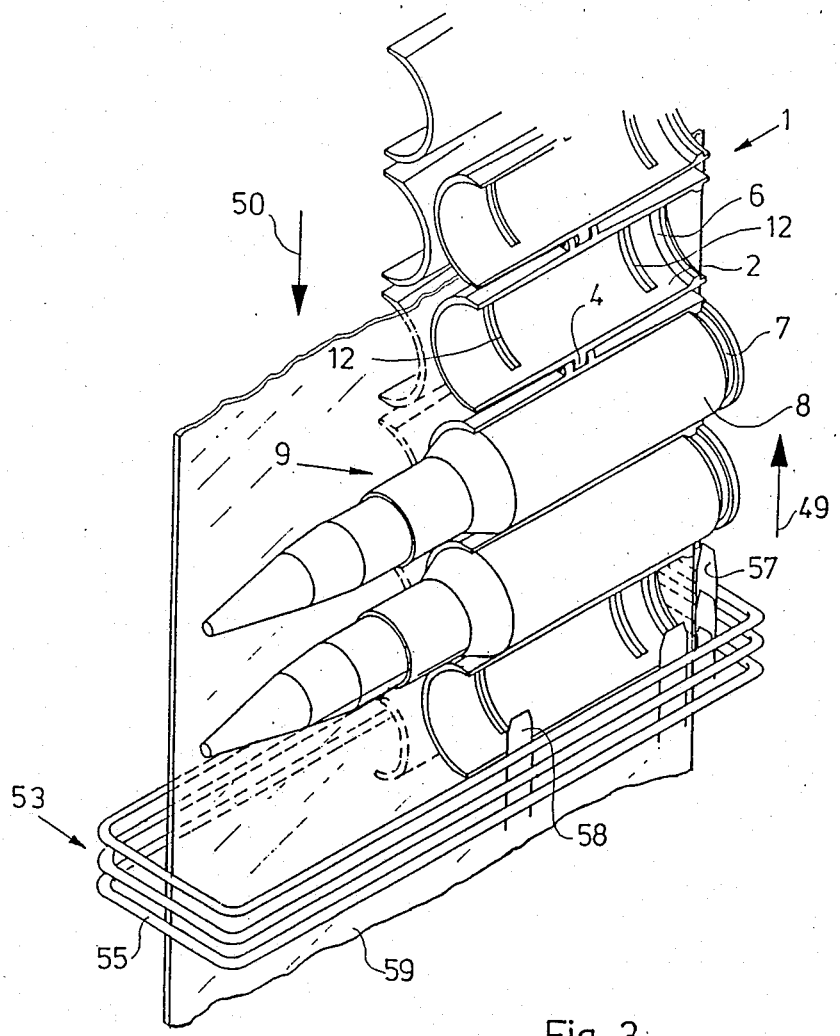
FIG. 3 shows a design of a flexible ammunition channel with the chain arranged therein, in a perspective view and partly broken away.

The chain 1 used in the examples comprises cups (unnumbered in FIGS. 1 and 2 but similar to those shown at 2, 2 in FIG. 3) which are pivotally interconnected by hinges such as shown at 4 in FIG. 3. Each of the cups 2 is provided on its hollow side with a guide web 6 engaging the extractor groove 7 of the case 8 of the cartridge 9 so as to retain the cartridge 9 in a defined position. In addition, each of the cups 2 is provided with slots extending in parallel to the transport direction of the chain, through which an ejector device can act upon the cartridges 9.

Figure 1:
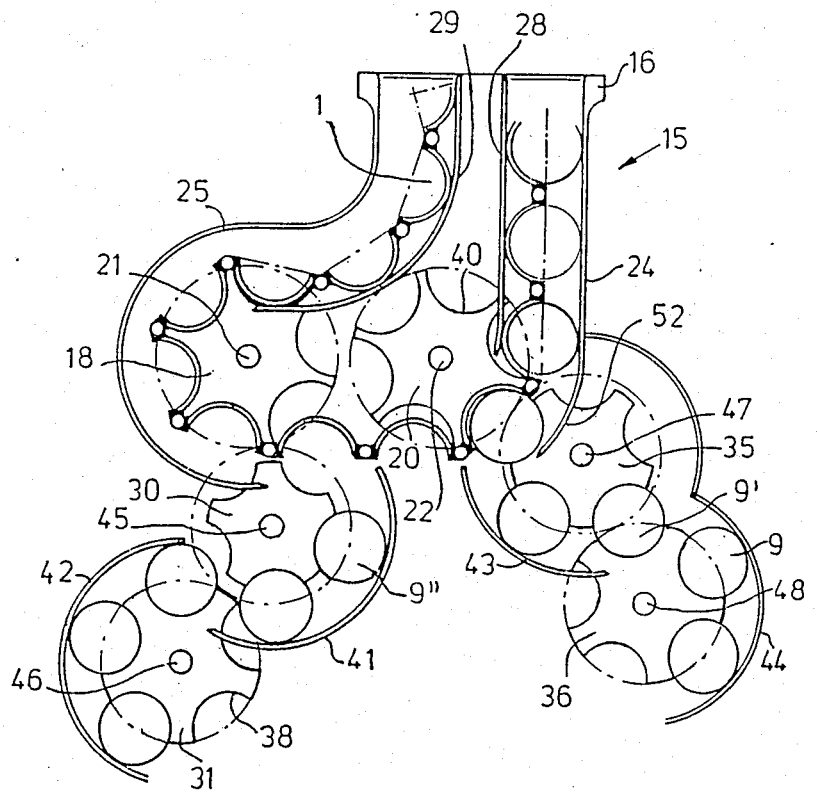
FIG. 1 shows the connecting piece of the feeder device for feeding cartridges from different magazines into the end of an ammunition channel facing away from the weapon.

FIG. 1 shows a connecting piece of a feeder device for the end of an ammunition channel facing away from the weapon. A housing 15 comprises a flange 16 for connection of a flexible ammunition channel 53 such as shown in FIG. 3. In the lower portion of the housing 15, two cup wheels 18 and 20 are seated to rotate about two fixed axes 21 and 22 extending in parallel to each other. These cup wheels 18 and 20 serve for deflecting the endless chain 1 and for feeding and discharging cartridges from two different magazines. The defined guide way of the chain 1 in the housing 15 is formed on the one hand by the walls 24 and 25 of the housing which abut that side of the cartridges which is not enclosed by the cups 5, and on the other hand by guide plates 28 and 29 arranged within the housing 15.

Below the cup wheel 18, a star wheel 30 and on the left below the latter a star wheel 31 can be seen. On the right below the cup wheel 20, a star wheel 35 and, still further below, a star wheel 36 can be seen. The star wheels 30, 31, 35 and 36 are provided with peripheral recesses 38 in the form of cups the radius of which is adapted to the radius of the cases 8 of the cartridges 9. Each of the star wheels is provided with five such peripheral recesses 38. Similarly, each of the cup wheels 18 and 20 comprises six such cup-shaped peripheral recesses 40 the radius of which is adapted to the outer radius of the cups 2. The star wheels 30, 31 on the one hand and 35, 36 on the other hand are partly enclosed by guide walls 41, 42, 43 and 44 forming cylinder segments. The distance between such guide walls and the axes 45, 46, 47, 48 of the respective star wheels is such that the cartridges held in the cup-shaped peripheral recesses are guided by the said guide walls by their—relative to the axes 45 to 48—radially outwardly sides facing away from the peripheral recesses, so that the cartridges 9 cannot come off the peripheral recesses.

Let us assume that the chain 1 in FIG. 1 is driven in a sense in which the right strand moves upwardly and the left strand moves downwardly, as indicated in FIG. 2 by the arrows 49 and 50. The magazine arranged below the star wheel 36, which is not shown in the drawing, feeds the star wheel 36 with cartridges 9 which for clarity's sake are crosshatched in the drawing. In the view shown in FIGS. 1 and 2, the star wheel 35 rotates in clockwise, the star wheel 36 in counter-clockwise direction, and the cartridges 9 take the path indicated by the row of cartridges shown in the drawing. The lower end of the guide wall 43 ensures that the cartridge 9′ held at any time between the two star wheels 35 and 36 is transported upwardly and prevented from following the rotation of the wheel 36 and moving downwardly. The star wheels 35 and 36 are driven in synchronism with each other, for smooth transfer of the individual cartridges between the star wheels. The drive of the star wheel 35 is further synchronized with the rotation of the cup wheel 20 so that the trouble-free transfer to the chain 1 is similarly ensured. The wall 24 is provided with web-like extensions 52 which project at an axial distance from the star wheel 35 into the path of the cartridges 9 so as to ensure that during rotation of the star wheel 35 the cartridges 9 are safely transferred to the chain 1 and fed upwardly.

The star wheels 30 and 31 stand still. The uppermost cartridge 9″ which is held by the star wheel 30 is located outside the area of the chain 1. The weapon (not shown in the drawing) is presently using the ammunition type fed by the star wheel 36 from the magazine not shown in the drawing. When the arrangement is to be switched over to the other cartridge type that can be fed to the star wheel 31, the sense of rotation of the chain 1 is reversed, just as the sense of rotation of the star wheels 35 and 36, and as a result of such reversal the cartridges present in FIGS. 1 and 2 in the right-hand strand of the chain 1 are fed back into the respective magazine. Simultaneously with the reversal of the sense of rotation, the star wheels 30 and 31 are set rotating, i.e. the star wheel 30 in counter-clockwise direction and the star wheel 31 in clockwise direction, and the latter is fed with cartridges of the other ammunition type from the magazine not shown in the drawing. The transfer to the chain 1 is effected analogously, with the sole exception that the cartridges of this other ammunition type are now fed upwardly in the left-hand strand of the chain 1.

The embodiment of a connecting piece for an ammunition channel shown in FIG. 2 differs from that shown in FIG. 1 in that the cup wheel 18 is missing so that in this arrangement the chain 1 is guided only over the cup wheel designated by 20′ in FIG. 2 and corresponding to the cup wheel 20. The guide plate 29′ is adapted to the changed path of the chain 1. Compared with FIG. 1, the star wheels 30′ and 31′ corresponding to the star wheels 30 and 31 are displaced to the right so that when the chain runs in the reverse direction they are in a position to feed cartridges into the same cup wheel 20′ which is also fed by the feeder device 35, 36. If the embodiment of the invention shown in FIG. 1 is modified according to the embodiment shown in FIG. 2, without omitting the cup wheel 18, i.e. if each cup wheel 18 and 20 is associated with two feeder devices, the two cup wheels 18 and 20 are coupled with a total of four feeder devices so that ammunition can be fed from four magazines. In this case it may be necessary to increase the center distance between the cup wheels 18 and 20, compared with FIG. 1.

The flexible ammunition channel 53 shown in FIG. 3 is formed by a wire 55 wound in the manner of a spiral of rectangular cross-section, and guide strips 57 and 58. The guide strips 57 and 58 serve as guides for the cups 2 of the chain 1 which in the absence of such strips could easily get jammed in the wire. The flexibility of the ammunition channel 53 permits the ammunition channel on the one hand to be bent about one or more axes extending in parallel to the axis of the cups 2, and on the other hand to be twisted about an axis extending vertically to the plane of the rectangular cross-section of the channel. A partition wall 59 provided in the longitudinal center plane of the ammunition channel 53 forms two guide channels so that ammunition can be simultaneously fed forward and backward through both channels.

The upper end of the flexible ammunition channel 53 shown in FIG. 3 is connected by conventional means to a housing of the type shown in FIG. 4. Ammunition channel 53 of FIG. 3 can be connected to the end 60—shown in the upper left of FIG. 4—of a cartridge feed mechanism 61. The latter comprises a housing 62 with a cup wheel 64 deflecting the chain 1 arranged in its upper left area. A total of two ejector cams 66 which are parallel and a distance apart are mounted to pivot about a fixed axis 65 fastened in the housing 62. The end faces 67 of the said cams 66, which face away from their axis 65, project through the slots 12 and into the path of the cartridge 9''' still retained in the chain 1 so as to eject the cartridge from the chain and into a peripheral recess of a star wheel 70 which is driven in synchronism with the cup wheel 64, i.e. at the same circumferential speed, but in a direction opposite to the sense of rotation of the said cup wheel 64. The ejector cam 66 is provided with sloping faces 68 and 69 which, depending on the sense of rotation of the chain 1, serve to push the cartridges out of the chain. The sloping faces 68 and 69 are arranged in a mirror-inverted manner with respect to the longitudinal center plane of the ejector cam 66. The ends of the sloping faces 68 and 69 facing away from the pivot axis end in the end face 67 of slightly convex shape. An ablong hole 72 provided in the ejector cam 66 at a distance from its axis 65 is engaged by a fixed bolt 73 which in this manner limits the pivot angle of the ejector cam 66. So, the liberty of movement of the end face 67 is restricted to a path smaller than the diameter of a cartridge. The distance between the end face 67 and the axis 71 of the star wheel 70 is just sufficiently great to ensure that the cartridge 9''' is not prevented by the end face 67 from rotating with the star wheel 70. The clear distance between the two wheels 64 and 70 amounts to about 40% of the diameter of the cartridge.

In order to ensure that the cartridges—which are again crosshatched in FIG. 4—will safely follow the star wheel 70 in clockwise direction, and the subsequent star wheels 74, 75 and 76 in counter-clockwise, clockwise and counter-clockwise direction, respectively, guide cams 81 to 83 and 81' to 83' are seated on the walls 78 and 80 of the housing 62 to pivot about an axis extending vertically to the plane of FIG. 4. By means of a shaft (only the shaft 83'' is visible in FIG. 5), each guide cam 81 to 83 and 81' to 83' has fastened to it against rotation a lever arm 85 extending outside the housing 62. The two lever arms 85 of the pair of guide cams 81 and 81' are interconnected by a shift rod 85' acting upon the ends of the lever arms so that the lever arms 85 connected in this manner extend at any time in parallel to each other.

When in the sense of rotation just described a guide cam, for instance the cam 81', is pivoted by a passing cartridge 9, the pivotal movement is transmitted to the guide cam 81 via the lever arm 85 and the associated shift rod 85'. The pivot angle of the guide cams 81 and 81' is equal to approx. 70°. So, the cartridge guided between the star wheels 70 and 74 is directed downwardly by the guide cam 81, as shown in FIG. 4. Now, the cartridge 9 is guided between the star wheel 74 and the housing wall 80. After the sense of rotation is reversed, a cartridge arriving from the upper strand of the chain 1 hits upon the guide cam 81 to pivot the latter and, via the lever arm 85, also the guide cam 81'. The same cartridge also pivots the cam 66 into its other end position. The cartridge 9, originally guided between the star wheels 70 and 74, is now travelling downwards between the housing wall 78 and the star wheel 74. In the condition shown in FIG. 4, in which the chain 1 rotates in counter-clockwise direction and the star wheels 74, 75 and 76 rotate in the sense described above, the individual guide cams 81 to 83 and 81' to 83' occupy the position shown in the drawing. Upon reversal of the sense of rotation of all wheels shown in FIG. 4, the guide cams are progressively transferred, in accordance with the travelling movement of the cartridges fed by the chain 1 in the reverse sense of rotation, to a position pivoted by about 70° thereby permitting the cartridge delivered by the upper strand of the chain 1 in FIG. 4 to be transported to the weapon to be arranged at the lower end of the housing 62. In order to prevent the guide cam 82 from changing its position already under the effect of minor vibrations, the guide cams are provided with detent means 99. In other embodiments of the invention it is also possible to control the position of the guide cams by separate drive motors. The cam 66 is also provided with detent means (ball notch).

The side walls of the housing are provided with guide cams 84, 84' also in the area where the chain 1 is deflected by the cup wheel 64. The said guide cams 84, 84' can be reversed together and assist the safe transfer of the cartridges ejected from the chain 1 to the star wheel 70. The guide cams 84, 84' are connected to the levers 85 by means of shafts (only the shaft 84''' is visible in FIG. 5), and the levers 85 are connected by a shift rod 85'.

Simultaneously with the reversal of the direction of movement of the chain 1, the sense of rotation of all star wheels 70 to 76 is reversed, and starting from the situation shown in FIG. 4 in which the transport mechanism is filled with cartridges right up to the loading opening of the weapon, all cartridges visible in FIG. 4 are initially transferred from the star wheels 70 to 76 to the chain 1. During this operation, the end face 67 prevents the cam 66 from being pivoted and keeps the cartridges in engagement with the star wheel 70 until they are directed into the chain by the guide cam 84. A control device not shown in the drawing in which on the one hand the number of cartridges present between the point of entry on the chain in FIG. 1 and the discharge opening 86 of the transport mechanism in FIG. 4 and, on the other hand, information on the number of cartridges retained in the star wheels 70 to 76 have been separately stored may ensure that upon reversal of the direction of movement of the chain the feeding of the other cartridge type into the chain will not commence until it can be safely assumed that no cartridge of the proceding type is present in the star wheel 70 of the mechanism of FIG. 4 when the first cartridge of the other cartridge type enters the area of the said star wheel. In the present case where the chain 1 is sufficiently long to permit each strand to accommodate at least as many cartridges as can be held in the star wheels 70 to 76, feeding of the new cartridge type into the chain 1 may be commenced immediately upon reversal of the direction of movement of the chain 1.

In the example described it was not possible for constructional reasons, in particular because of the kink in the transport mechanism between the chain 1 and the star wheel arrangement 70 to 76, to bring the chain closer to the star wheel 70 in the area of the deflecting star wheel 64. In cases where the chain can be arranged closer to the star wheel 70 so that the chain and the star wheel 70 are almost in contact with each other, the cartridges can be directed from the chain to the star wheel 70 by the guide cams 84 and 84' alone, and there will be no need for a cam 66. In the present case, the length of the cam 66 is such that the cartridges are almost fully pushed into the peripheral recesses in the star wheel 70 by the end portion of the cam opposite its pivot point 65.

FIG. 5 shows in its upper portion a view of the interior of the end portion 60 of the transport mechanism 61. Gears 87 to 90 which form a gearing are fastened against rotation to shafts 91 to 94 which carry the commonly driven cup wheel 64 and star wheels 70, 74, 75 and 76. The driving arrangement for the transport mechanism 61 which can be seen in FIG. 5 is arranged coaxially with and partly within the star wheel 76. This arrangement comprises an actuator lever 100 coupled with the gas pressure piston of the weapon—not shown in the drawing—which transmits the pivotal movement of the actuator lever via a front ratchet 102 and a rear ratchet 104 to an actuator spring 106 designed as spiral spring which ensures that the jerky movements transmitted by the weapon to the actuator lever are balanced. The right end 108 of the spring 106 in FIG. 5 drives a shaft 110 in one sense of rotation. The shaft 110 carries a clutch slide 112 which is fixed against rotation but can be displaced in the longitudinal direction by a shift lever 114. The shift lever 114 is connected to a reversing mechanism which carries out the necessary switching operations when the ammunition type is changed. In the position shown in the drawing the clutch slide 112 engages a gear 118 via shift dogs 116. The gear 118 is in turn fixed against rotation to the star wheel 76 and, on the other hand, in engagement with the gear 90. A pinion not shown in FIG. 5 engages simultaneously a bevel toothing 120 of the gear 118 and a bevel toothing 122 of a reversing wheel 124 which because of the fact that the pinion is seated on a fixed axis always rotates in a direction opposite to the sense of rotation of the gear 118. In the position shown in the drawing, the reversing wheel 124 is out of engagement with the shift dogs 126 of the clutch slide 112. Now, when the clutch slide 112 is shifted to the right in FIG. 5 by the actuator lever 114, the rotary movement of the shaft 110 is directly transmitted to the reversing wheel 124 so that the pinion reverses the sense of rotation of the gear 118 which is now no longer in engagement with the clutch slide 112. As a result, the sense of rotation of all wheels shown in FIG. 4 is reversed.

FIG. 6 shows an embodiment of a cartridge feed mechanism which is provided with an ejector cam 166 in the left proximate end portion of the chain 131 provided with cups. In this arrangement, the adjoining parts to which the cartridges 9 must be tansferred from the chain 131 must be fastened to mounting points 133 of a rigid end portion 135 of an ammunition channel 137 exhibiting a flexible center portion. The distant feeding end—to be seen on the right in FIG. 6—of the ammunition channel 137 comprises only a single cup wheel 140 with peripheral recesses 141, for deflection of the chain 131. The cup wheel 140 is arranged within a rigid end portion 142 which is in turn provided with mounting points 133 connected to a magazine 144 designed as a compact unit but permitting two different cartridge types to be stored in separate areas. In the drawing, the magazine 144 is broken away and the two cartridge types are to be seen on the one hand above and, on the other hand, below a star wheel 150. The star wheel 150 is provided with peripheral recesses 152 of a shape shallower than would correspond to the radius of the cartridges 9. The reason for this is to be seen in the fact that the cartridges 9 are guided in the magazine by chains 154 and 156 passing through the magazine along meander-shaped paths and provided with rods 158 in the form of a ladder which merely serve to displace the cartridges 9, any unwanted lateral displacement of the cartridges being prevented by rigid walls 160 of the magazine 144. The chains 154 and 156 are deflected by deflection wheels not shown in the drawing, in the immediate neighborhood of the star wheel 150. To ensure optimum utilization of the space in the magazine, the pitch of the chains 154 and 156 is smaller than that of the chain 131 which in view of the cups must have a relatively great pitch. The difference in pitch is compensated by different circumferential speeds of the star wheels 140 and 150. This leads to certain displacements of the cartridges so that the peripheral recesses 152 must be relatively wide to allow for this fact. When cartridges from the upper magazine—in FIG. 6—are to be fed, the star wheel 150 rotates in counter-clockwise direction while the cup wheel 140 turns in clockwise direction. When cartridges from the lower portion of the magazine are to be fed, the two wheels rotate in the opposite directions. Here again, guide cams 161 mounted for being commonly pivoted are provided to ensure safe feeding of the cartridges 9 to the cup wheel 140.

Contrary to the arrangement shown in FIG. 2, the ejector cam 166 has no distinct end face such as shown at 67 in FIG. 4 and 4*a*, but merely a rounded tip 167, the end portions of the sloping faces 68 and 69 opposite their pivot axis 65 being almost in contact with each other in FIG. 4. Also, the cam 166 is a little narrower than the cam 66 and the oblong hole 172 is somewhat shorter, whereby the pivot angle of the cam 166 is somewhat reduced. The cam is in any case suited for cases in which the cartridges 9 are to be transported only to the left in FIG. 6 for being for instance directly fed into a weapon. However, if the possibility is to be provided to feed cartridges back to the magazine arrangement from a transport mechanism arranged on the right side in FIG. 6—as in the case of FIG. 2—it may be convenient to provide the cam 66 instead of the cam 166.

A driving arrangement of the type shown in the bottom portion of FIG. 5 has been known from German Disclosed Patent Application No. 28 25 091 (DE 28 25 091 A1).

FIG. 7 shows a perspective view of the entire arrangement comprising the parts shown in FIGS. 1, 3, 4 and 5.

A box-shaped magazine 200 comprises the mechanism shown in FIG. 1 which is driven via a gearing through electric motors 202 and 204. The uppermost gears 206 and 208 drive the cup wheels 18 and 20 of FIG. 1. The box-shaped magazine 200 is followed on top by the flexible ammunition channel 53 extending substantially upwardly and having its upward end connected to the cartridge feed mechanism 61 shown in FIG. 4. The discharge end 60 of the transport mechanism 61, which in FIG. 4 is to be seen in the right top portion, points in FIG. 7 downwardly, while the series of star wheels 70, 74, 75 and 76 is arranged horizontally, contrary to the arrangement in FIG. 4, where for reasons of space they were shown in vertical arrangement. The lower end—in FIG. 4—of the mechanism 61 is connected with the loading opening of the gun 220. The entire arrangement is mounted on a vehicle, with a seat 230 for the operator being arranged in front of the magazine 200.

The cartridge feed mechanism of the example-described is intended for caliber 25 mm×137, while the different ammunition types envisaged are "high explosive" and "armor piercing".

With respect to FIG. 4, the width of the end face 67 in the example is 0.4 times the diameter of a cartridge. The end face 67 occupies an angle of 9 degrees as seen from the axis 65. The angle which the two sloping faces 68 and 69 include with the longitudinal center plane of the cam 66, is 36 degrees. The pivot angle of the cam 66 is 12 degrees. The maximum width of the cam 66 is in the region of the oblong hole 72 and is 1.7 times as much as the diameter of the cartridge. The return radius of the cup wheel 64 (as measured till the axis of the cartridges) is 1.25 times the diameter of a cartridge. With its upper part in FIG. 4, the cam 66 projects into the cups 2 of the chain 1. This does not cause any obstruction, because for the shown direction of rotaion of the chain 1 there are no cartridges in the upper strand of the chain 1 in the region of the cam 66.

I claim:

1. A cartridge feed mechanism for feeding cartridges so that each cartridge moves in a direction transverse to its longitudinal direction, comprising at least two neighboring star wheels driven at equal circumferential speeds and in opposite directions, said star wheels having cup-shaped peripheral recesses forming common retaining means for a cartridge in the area of the smallest radial distance between said star wheel, guides to prevent the cartridges from sliding off the peripheral recesses, said guides being spaced from the axes of the star wheels to permit the transportation of the cartridges in both directions of movement of said star wheels, drive means coupled with the star wheels for selectively driving the star wheels in alternative directions of movement, and said guides including reversible guide elements for directing the cartridges into the peripheral recesses of the next following star wheels, and said guide elements provided on both sides of a plane extending to the axes of said two neighboring star wheels, and provided substantially in the area of a tangential plane associated with said two star wheels and extending perpendicularly to said plane through said star wheel axes.

2. The device according to claim 1 further characterized by at least one sensing element provided in the path of movement of said cartridges and coupled to at least one guide, said sensing element being responsive to cartridge movement in a predetermined feeding direction for controlling the said reversible guide elements.

3. The device according to claim 2 wherein said at least one sensing element comprises another of said reversible guide elements.

4. The device according to claim 3 wherein said guide elements are provided in pairs, and are coupled one with another in each of said pairs.

5. The device according to claim 1 wherein one of said oppositely dirven star wheels comprises a reversible chain for transporting cartridges, said chain including cup-shaped peripheral recesses travelling around a sprocket adjacent to the other of said two neighboring star wheels.

6. The device according to claim 1 further characterized by a drive mechanism for one of said star wheels and including an input drive member movable in a first direction, an output driven member rotatable in one and an opposite direction and coupled to said one star wheel, and means for reversing the direction of motion for said output driven member while keeping the sense of rotation for said input drive member constant.

* * * * *